US010463160B2

(12) United States Patent
Tsai

(10) Patent No.: US 10,463,160 B2
(45) **Date of Patent: *Nov. 5, 2019**

(54) LIGHTWEIGHT MODULAR BED

(71) Applicant: ULIFE HEALTHCARE INC., Taichung (TW)

(72) Inventor: Chi-Lung Tsai, Taichung (TW)

(73) Assignee: ULIFE HEALTHCARE INC., Taichung (TW)

( * ) Notice: Subject to any disclaimer, the term of this patent is extended or adjusted under 35 U.S.C. 154(b) by 48 days.

This patent is subject to a terminal disclaimer.

(21) Appl. No.: 15/806,906

(22) Filed: Nov. 8, 2017

(65) Prior Publication Data

US 2018/0235373 A1 Aug. 23, 2018

(30) Foreign Application Priority Data

Feb. 18, 2017 (TW) ..... 106202395 U

(51) Int. Cl.

| | |
|---|---|
| ***A47C 19/02*** | (2006.01) |
| ***A47C 19/00*** | (2006.01) |
| ***A47C 19/12*** | (2006.01) |
| ***A47C 20/04*** | (2006.01) |
| ***A47C 20/08*** | (2006.01) |

(52) U.S. Cl.

CPC ..... *A47C 19/025* (2013.01); *A47C 19/005* (2013.01); *A47C 19/12* (2013.01); *A47C 20/041* (2013.01); *A47C 20/08* (2013.01)

(58) Field of Classification Search

CPC ..... A47C 19/025; A47C 19/005; A47C 19/12; A47C 19/04; A47C 19/045; A47C 19/126; A47C 19/124; A47C 20/12; A47C 20/041; A47C 20/08; A47C 21/02; A47C 21/022; A47C 21/06; A47C 29/00; A47C 29/003; A47C 29/006

See application file for complete search history.

(56) References Cited

U.S. PATENT DOCUMENTS 3,854,152 A * 12/1974 Chez ..... A61G 7/1019 5/81.1 C
3,994,033 A * 11/1976 Bendell ..... A47C 23/20 5/202
4,012,800 A * 3/1977 Mitchell ..... A23B 7/148 5/187
4,239,281 A * 12/1980 Luca' ..... A47C 17/213 297/108

(Continued)

*Primary Examiner* — Robert G Santos
*Assistant Examiner* — Rahib T Zaman
(74) *Attorney, Agent, or Firm* — Allen, Dyer, Doppelt + Gilchrist, PA

(57) ABSTRACT

A lightweight modular bed includes a front base frame, a rear base frame, a front support frame unit mounted on the frame base frame, a rear support frame unit mounted on the rear base frame, a first front linkage unit with a first front retaining member, a second front retaining member, a first rear linkage unit with a first rear retaining member, a second rear retaining member, a front supporting web which has two lateral portions retained by the first and second front retaining members, and a rear support web which has two lateral portions retained by the first and second rear retaining members. When each of the first front and rear retaining members is displaced to a stretching position, a corresponding one of front and rear support webs is fully stretched.

7 Claims, 9 Drawing Sheets

(56) References Cited

U.S. PATENT DOCUMENTS

| | | | | | |
|---|---|---|---|---|---|
| 4,479,993 | A * | 10/1984 | James | A61G 7/001 | 428/192 |
| 4,771,489 | A * | 9/1988 | Chen | A61G 5/006 | 4/585 |
| 5,860,175 | A * | 1/1999 | Saiki | A45F 3/26 | 5/111 |
| 6,151,730 | A * | 11/2000 | Weston | A47C 19/122 | 5/110 |
| 6,588,037 | B1 * | 7/2003 | Eno | A47C 29/006 | 135/90 |
| 6,687,930 | B1 * | 2/2004 | Eads | A47C 29/003 | 135/121 |
| 6,694,547 | B1 * | 2/2004 | Vail | A47C 29/003 | 5/414 |
| 7,246,389 | B2 * | 7/2007 | Taguchi | A61G 7/001 | 5/608 |
| 10,154,931 | B1 * | 12/2018 | Vann | A61G 7/015 | |
| 2001/0054198 | A1 * | 12/2001 | Choi | A47C 4/286 | 5/114 |
| 2006/0085913 | A1 * | 4/2006 | Kawakami | A47C 19/045 | 5/618 |
| 2009/0119837 | A1 * | 5/2009 | Benezra | A47D 5/00 | 5/424 |
| 2016/0270992 | A1 * | 9/2016 | Wang | A61G 7/015 | |
| 2017/0209321 | A1 * | 7/2017 | Shih | A61G 7/018 | |
| 2018/0318158 | A1 * | 11/2018 | Tsai | A61G 7/015 | |

* cited by examiner

X
Y
3
FP1
5
561
56
55
562
571
57
572
501
51
502
352
301
35
36
31
59
503
504
302
351
33
13
1
583
581
584
58
F
585
582
586
R
683
69
681
684
685
68
682
2
686
604
603
462
402
42
4
RP1
6
62
401
672
67
601
671
65
66
662
661
61
602
63
44
46
461
45
452
43
47
41
451
32
34
22
53
52
501
502
301
351
13
33
302
35
36
31
352
59
503
504

LIGHTWEIGHT MODULAR BED

CROSS-REFERENCE TO RELATED APPLICATION

This application claims priority from Taiwanese utility model patent application no. 106202395, filed on Feb. 18, 2017.

FIELD

The disclosure relates to a modular bed, more particularly to a lightweight modular bed.

BACKGROUND

A conventional bed frame, such as an electric bed frame disclosed in U.S. patent application publication no. 2017/0209321 A1, includes a fixed rack, a movable rack, a thigh rack, a shank rack, an actuator, four supporting boards, and a bracket. The conventional bed frame including the supporting boards is heavy and inconvenient for transportation.

SUMMARY

Therefore, an object of the disclosure is to provide a lightweight modular bed.

According to the disclosure, a lightweight modular bed includes a front base frame, a rear base frame, a front support frame unit, a rear support frame unit, a first front linkage unit, a second front retaining member, a first rear linkage unit, a second rear retaining member, a front supporting web, and a rear supporting web. The rear base frame is aligned with the front base frame in a longitudinal direction to permit the front and rear base frames to be arranged in a head-to-tail arrangement. The front support frame unit is mounted on the front base frame, and includes a front leading bar and a front trailing bar. The front leading bar extends in a transverse direction relative to the longitudinal direction to terminate at a first end segment and a second end segment. The front trailing bar is spaced apart from the front leading bar in the longitudinal direction, and extends in the transverse direction to terminate at a first end segment and a second end segment. The rear support frame unit is mounted on the rear base frame, and includes a rear leading bar and a rear trailing bar. The rear leading bar extends in the transverse direction to terminate at a first end segment and a second end segment. The rear trailing bar is spaced apart from the rear leading bar in the longitudinal direction, and extends in the transverse direction to terminate at a first end segment and a second end segment. The first front linkage unit includes a first front leading link, a first front trailing link, and a first front retaining member. Each of the first front leading link and the first front trailing link has a first front coupling end and a first front pivot end that is opposite to the first front coupling end, and that is pivotally mounted on the first end segment of a corresponding one of the front leading and trailing bars about a first front pivot axis in the longitudinal direction. The first front retaining member has a first front leading segment and a first front trailing segment which are opposite to each other, and which are coupled to the first front coupling ends of the first front leading and trailing links, respectively. The first front retaining member is angularly movable about the first front pivot axis between a front non-stretching position, where the first front retaining member is remote from the ground, and a front stretching position, where the first front retaining member is close to the ground. The second front retaining member is opposite to the first front retaining member in the transverse direction, and has a second front leading segment and a second front trailing segment that are opposite to each other, and that are coupled to the second end segments of the front leading and trailing bars, respectively. The first rear linkage unit includes a first rear leading link, a first rear trailing link, and a first rear retaining member. Each of the first rear leading link and the first rear trailing link has a first rear coupling end and a first rear pivot end that is opposite to the first rear coupling end, and that is pivotally mounted on the first end segment of a corresponding one of the rear leading and trailing bars about a first rear pivot axis in the longitudinal direction. The first rear retaining member has a first rear leading segment and a first rear trailing segment which are opposite to each other, and which are coupled to the first rear coupling ends of the first rear leading and trailing links, respectively. The first rear retaining member is angularly movable about the first rear pivot axis between a rear non-stretching position, where the first rear retaining member is remote from the ground, and a rear stretching position, where the first rear retaining member is close to the ground. The second rear retaining member is opposite to the first rear retaining member in the transverse direction, and has a second rear leading segment and a second rear trailing segment that are opposite to each other, and that are coupled to the second end segments of the rear leading and trailing bars, respectively. The front supporting web is configured to be stretchable on the front support frame unit, and has a front web body, a first lateral portion, and a second lateral portion. The first and second lateral portions are connected to a first juncture and a second juncture of the front web body, respectively, and are coupled to the first and second front retaining members, respectively, such that when the first front retaining member is displaced to the front stretching position, the front web body is fully stretched on the front support frame unit. The rear supporting web is configured to be stretchable on the rear support frame unit, and has a rear web body, a third lateral portion, and a fourth lateral portion. The third and fourth lateral portions are connected to a third juncture and a fourth juncture of the rear web body, respectively, and are coupled to the first and second rear retaining members, respectively, such that when the first rear retaining member is displaced to the rear stretching position, the rear web body is fully stretched on the rear support frame unit.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
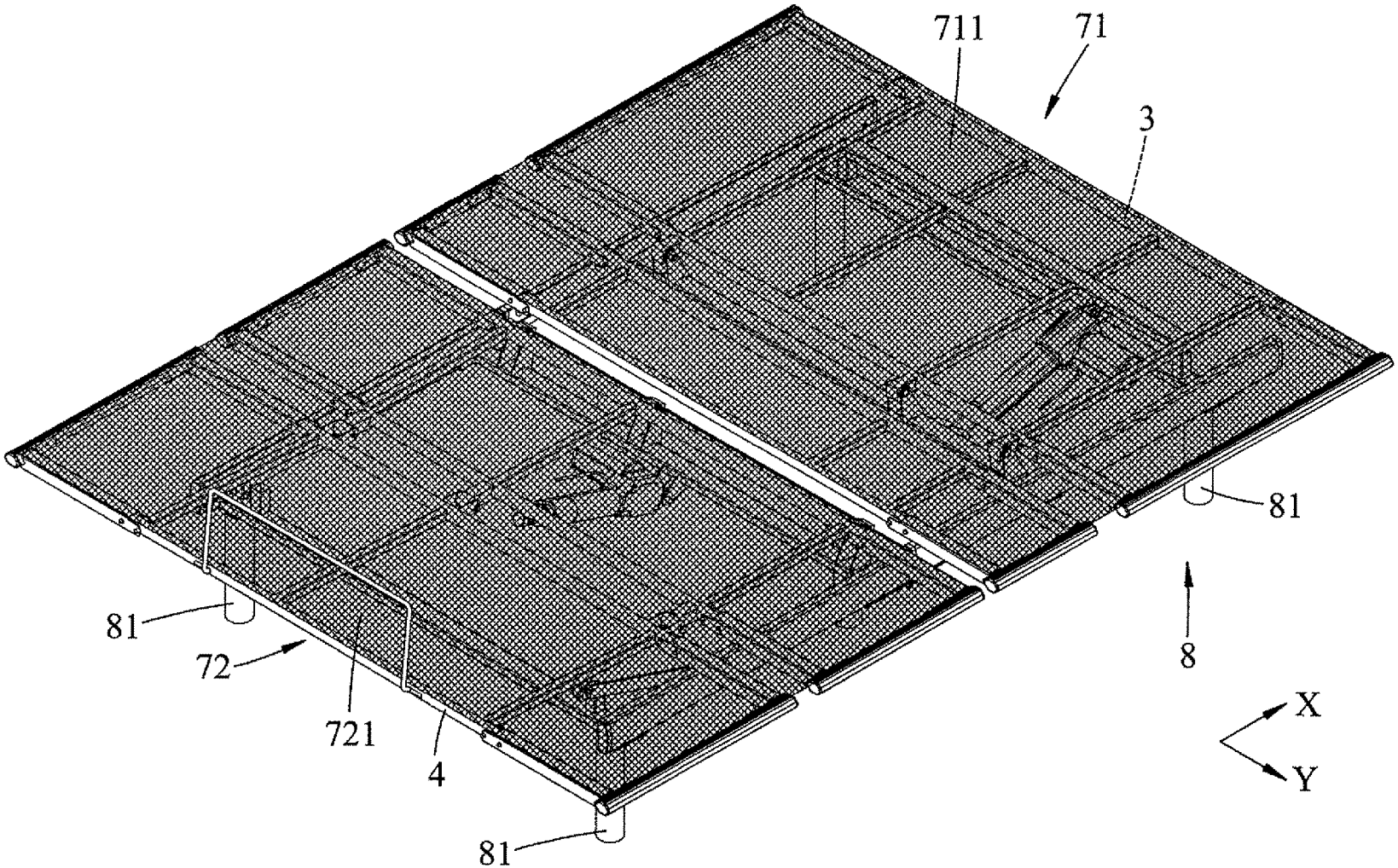
FIG. 1 is a perspective view of a lightweight modular bed according to an embodiment of the disclosure.
Figure 2:
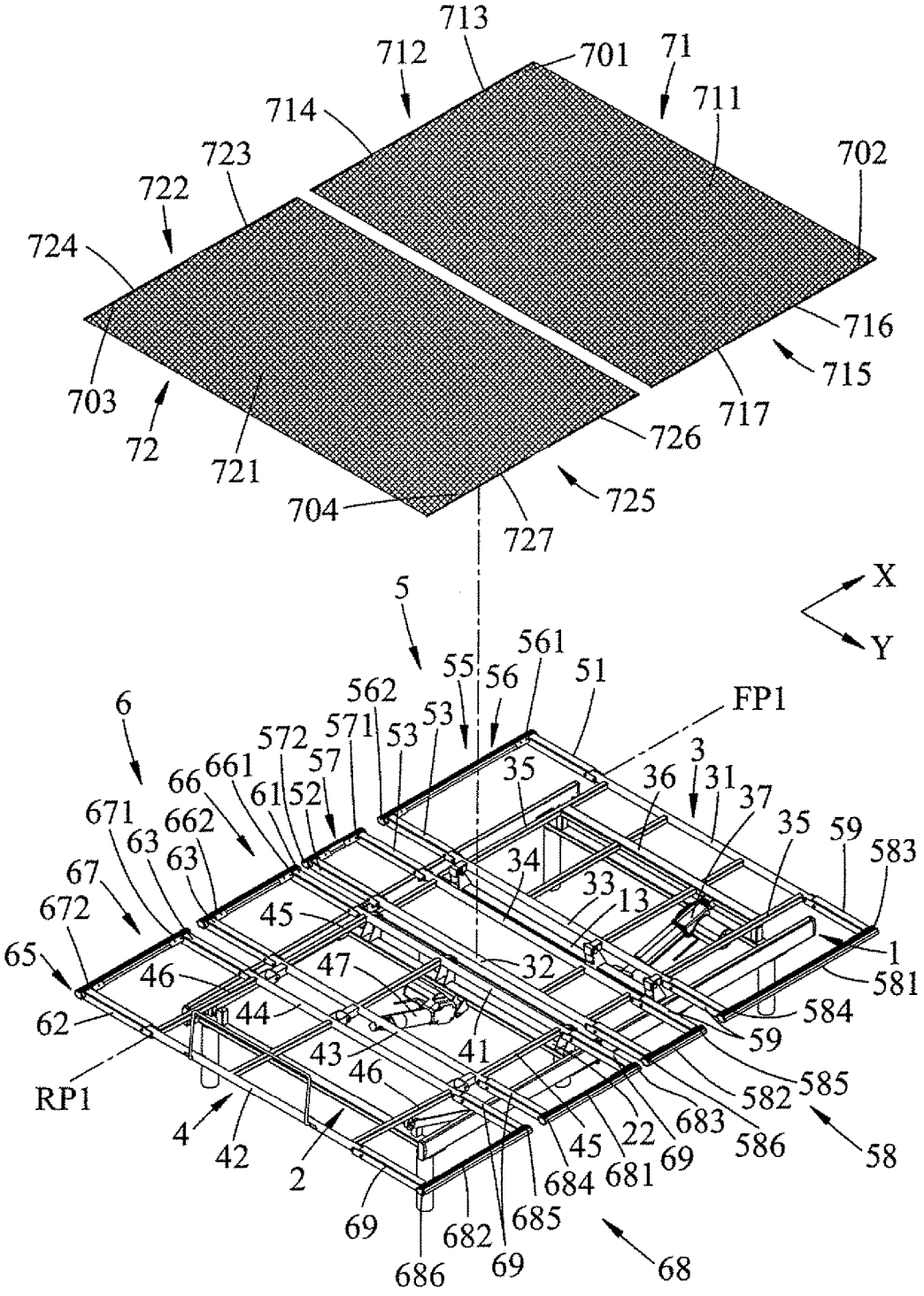
FIG. 2 is a partially exploded perspective view of the lightweight modular bed.
Figure 4:
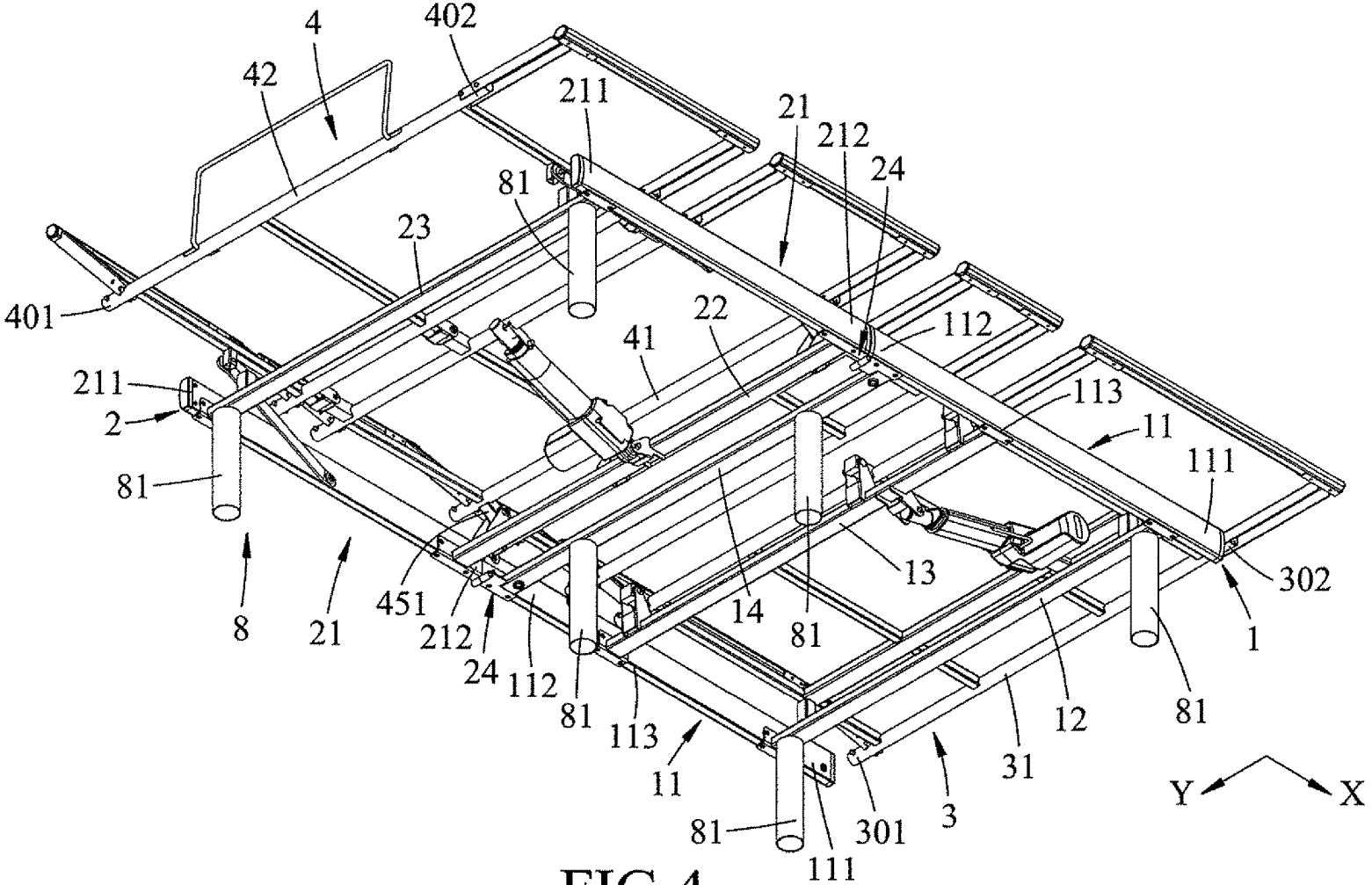
FIG. 4 is a bottom perspective view of the lightweight modular bed in which front and rear supporting webs are omitted.

With reference to FIGS. 1, 2, and 4, a lightweight modular bed according to an embodiment of the disclosure is shown to include a front base frame 1, a rear base frame 2, a front support frame unit 3, a rear support frame unit 4, a first front linkage unit 5, a second front retaining member 58, a first rear linkage unit 6, a second rear retaining member 68, a front supporting web 71, and a rear supporting web 72.

As shown in FIG. 4, the rear base frame 2 is aligned with the front base frame 1 in a longitudinal direction (X) to permit the front and rear base frames 1, 2 to be arranged in a head-to-tail arrangement.

In this embodiment, the front base frame 1 includes two front beams 11, a first front transverse beam 12, a second front transverse beam 13, and a third front transverse beam 14.

Each of the front beams 11 extends in the longitudinal directions (X) to terminate at a front end segment 111 and a first connecting end segment 112, and has an intermediate segment 113 between the front end segment 111 and the first connecting end segment 112. The front beams 11 are spaced apart from each other in a transverse direction (Y) relative to the longitudinal direction (X).

The first front transverse beam 12 extends in the transverse direction (Y) to interconnect the front end segments 111 of the front beams 11.

The second front transverse beam 13 extends in the transverse direction (Y) to interconnect the intermediate segments 113 of the front beams 11.

The third front transverse beam 14 extends in the transverse direction (Y) to interconnect the first connecting end segments 112 of the front beams 11.

In this embodiment, the rear base frame 2 includes two rear beams 21, a first rear transverse beam 22, and a second rear transverse beam 23.

The rear beams 21 are spaced apart from each other in the transverse direction (Y). Each of the rear beams 21 extends in the longitudinal direction (X) to terminate at a rear end segment 211 and a second connecting end segment 212 which is hingedly connected to the first connecting end segment 112 of a corresponding one of the front beams 11 using a hinge member 24.

The first rear transverse beam 22 extends in the transverse direction (Y) to interconnect the second connecting end segments 212 of the rear beams 21.

The second rear transverse beam 23 extends in the transverse direction (Y) to interconnect the rear end segments 211 of the rear beams 21.

Figure 6:
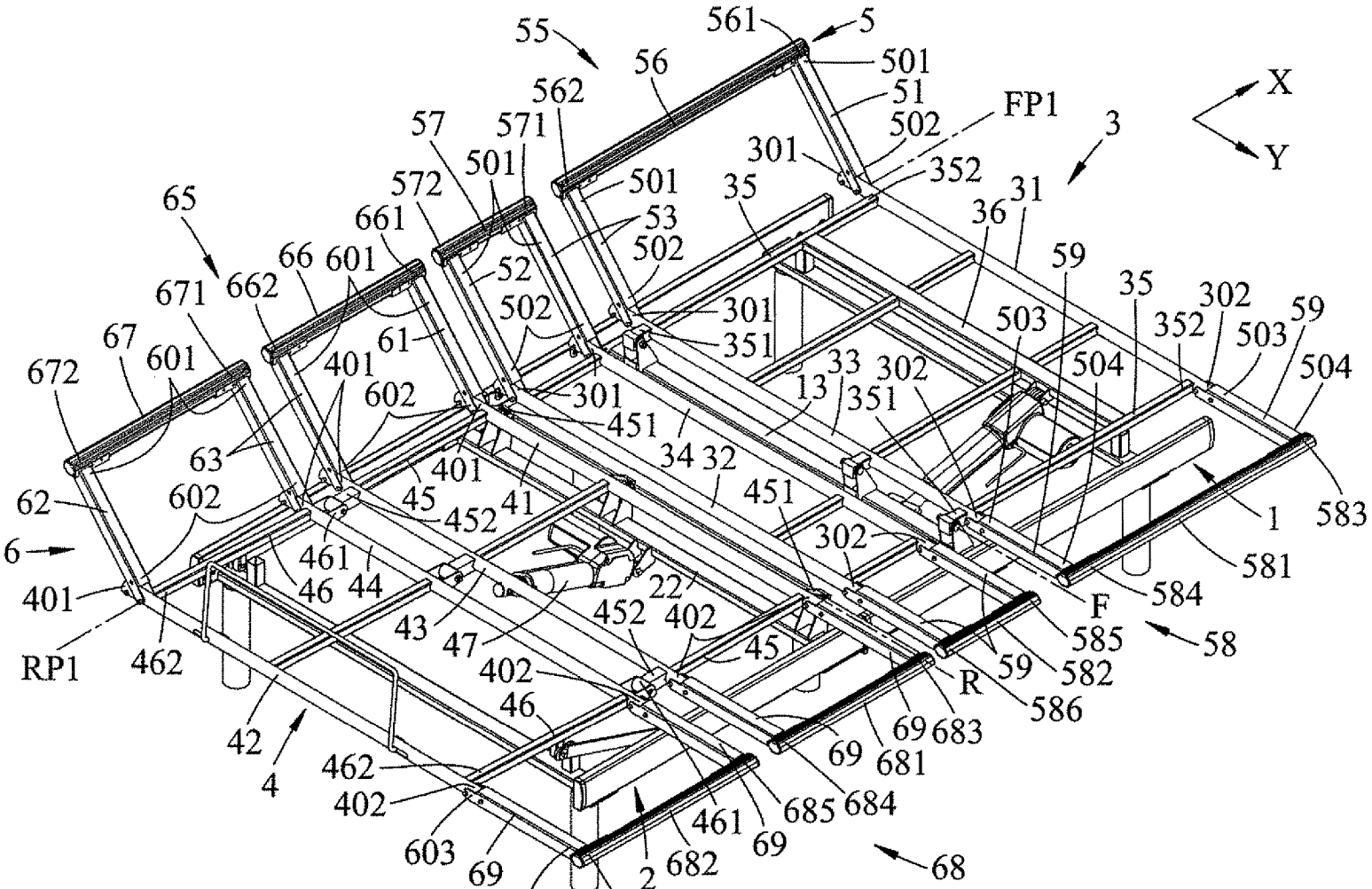
FIG. 6 is a top perspective view of the lightweight modular bed in which the front and rear supporting webs are omitted.

Referring to FIGS. 2 and 6, it can be observed that the front support frame unit 3 is mounted on the front base frame 1, and includes a front leading bar 31 and a front trailing bar 32.

As shown in FIG. 6, the front leading bar 31 extends in the transverse direction (Y) to terminate at a first end segment 301 and a second end segment 302.

The front trailing bar 32 is spaced apart from the front leading bar 31 in the longitudinal direction (X), and extends in the transverse direction (Y) to terminate at a first end segment 301 and a second end segment 302.

In this embodiment, the front support frame unit 3 further includes a pair of head support links 35, a first front intermediate bar 33, a second front intermediate bar 34, a third front intermediate bar 36.

Figure 9:
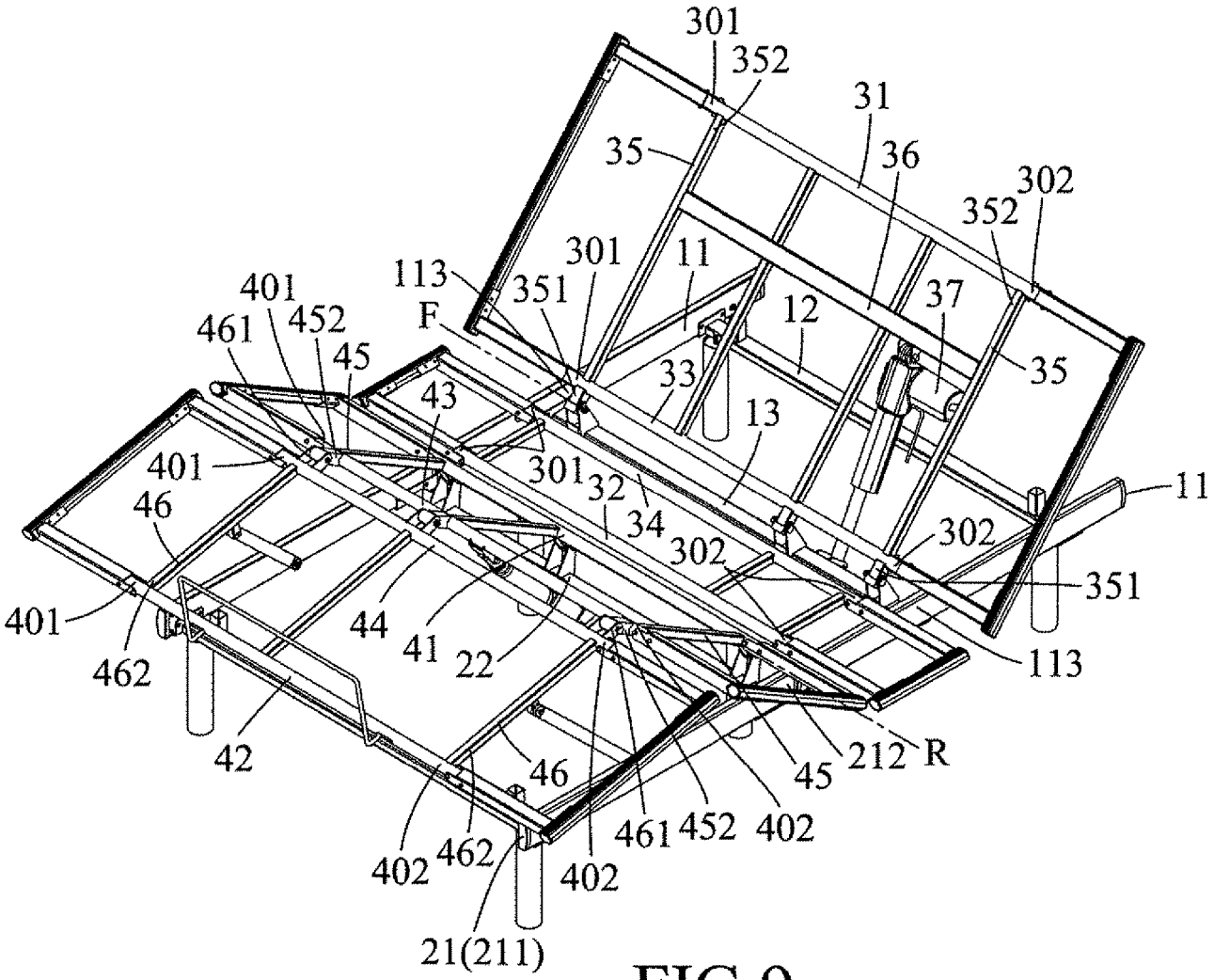
FIG. 9 is a perspective view of the lightweight modular bed in which the front and rear supporting webs are omitted, a pair of head support links are in a head elevated position, and a first rear intermediate bar is in a leg elevated position.

Each of the head support links 35 has a front link pivot end 351 and a front link coupling end 352. The front link pivot end 351 is mounted pivotally on the second front transverse beam 13 about a front axis (F) in proximity to a corresponding one of the intermediate segments 113 of the front beams 11. The front link coupling end 352 is opposite to the front link pivot end 351, and is connected to the front leading bar 31 in proximity to a corresponding one of the first and second end segments 301, 302 of the front leading bar 31 to permit the head support links 35 to move with the front leading bar 31 such that the front leading bar 31 is rotatably liftable about the front axis (F) from a head normal position to a head elevated position. When the front leading bar 31 is in the head normal position, as shown in FIG. 2, the front leading bar 31 is close to the ground. When the front leading bar 31 is in the head elevated position, as shown in FIG. 9, the front leading bar 31 is remote from the ground.

The first front intermediate bar 33 extends in the transverse direction (Y) to interconnect the head support links 35 in proximity to the front link pivot ends 351 of the head support links 35 so as to move with the head support links 35. The first front intermediate bar 33 has a first end segment 301 and a second end segment 302 which are opposite to each other, and which are disposed outboard of the head support links 35.

The second front intermediate bar 34 extends in the transverse direction (Y) to terminate at a first end segment 301 and a second end segment 302, and is disposed between the first front intermediate bar 33 and the front trailing bar 32. The second front intermediate bar 34, together with the front trailing bar 32, is secured on the front beams 11.

The third front intermediate bar 36 is disposed between the front leading bar 31 and the first front intermediate bar 33, and extends in the transverse direction (Y) to interconnect the head support links 35 so as to permit the front leading bar 31 and the head support links to move therewith. As shown in FIGS. 2 and 9, a front jack member 37 is coupled between the third front intermediate bar 36 and the second front transverse beam 13 so as to permit the front leading bar 31 to be driven by the front jack member 37 to move between the head normal position (FIG. 2) and the head elevated position (FIG. 9).

Referring back to FIGS. 2 and 6, it can be observed that the rear support frame unit 4 is mounted on the rear base frame 2, and includes a rear leading bar 41 and a rear trailing bar 42.

As shown in FIG. 6, the rear leading bar 41 extends in the transverse direction (Y) to terminate at a first end segment 401 and a second end segment 402.

The rear trailing bar 42 is spaced apart from the rear leading bar 41 in the longitudinal direction (X), and extends in the transverse direction (Y) to terminate at a first end segment 401 and a second end segment 402.

In this embodiment, the rear support frame unit 4 further includes a pair of front leg support links 45, a pair of rear leg support links 46, a first rear intermediate bar 43, and a second rear intermediate bar 44.

Each of the front leg support links 45 has a first rearward pivot end 452 and a first forward pivot end 451 which is opposite to the first rearward pivot end 452 and which is mounted pivotally on the first rear transverse beam 22 about a rear axis (R) in proximity to a corresponding one of the second connecting end segments 212 of the rear beams 21. The front leg support links 45 are interconnected by the rear leading bar 41 in proximity to the first forward pivot ends 451 of the front leg support links 45 so as to permit the rear leading bar 41 to move with the front leg support links 45. In addition, the first and second end segments 401, 402 of the rear leading bar 41 are disposed outboard of the front leg support links 45.

Each of the rear leg support links 46 has a second forward pivot end 461 and a second rearward connected end 462. The second forward pivot end 461 is hingedly mounted to the first rearward pivot end 452 of a corresponding one of the front leg support links 45. The second rearward connected end 462 is opposite to the second forward pivot end 461, and is mounted on the rear trailing bar 42 in proximity to a corresponding one of the first and second end segments 401, 402 of the rear trailing bar 42.

The first rear intermediate bar 43 extends in the transverse direction (Y) through the front leg support links 45 in proximity to the first rearward pivot ends 452 of the front leg support links 45 to terminate at a first end segment 401 and a second end segment 402 so as to permit the first rear intermediate bar 43 to be rotatably liftable about the rear axis (R) from a leg normal position to a leg elevated position. When the first rear intermediate bar 43 is in the leg normal position, as shown in FIG. 2, the first rear intermediate bar 43 is close to the ground. When the first rear intermediate bar 43 is in the leg elevated position, as shown in FIG. 9, the first rear intermediate bar 43 is remote from the ground. As shown in FIGS. 2 and 9, a rear jack member 47 is coupled between first rear intermediate bar 43 and the first rear transverse beam 22 so as to permit the first rear intermediate bar 43 to be driven by the rear jack member 47 to move between the leg normal position (FIG. 2) and the leg elevated position (FIG. 9).

The second rear intermediate bar 44 extends in the transverse direction (Y) through the rear leg support links 46 in proximity to the second forward pivot ends 461 of the rear leg support links 46 to terminate at a first end segment 401 and a second end segment 402 so as to permit the second rear intermediate bar 44 to be lifted when the first rear intermediate bar 43 is lifted to the leg elevated position from the leg normal position.

The first front linkage unit 5 includes a first front leading link 51, a first front trailing link 52, and a first front retaining member 55.

As best shown in FIG. 6, each of the first front leading link 51 and the first front trailing link 52 has a first front coupling end 501 and a first front pivot end 502 which is opposite to the first front coupling end 501, and which is pivotally mounted on the first end segment 301 of a corresponding one of the front leading and trailing bars 31, 32 about a first front pivot axis (FP1) in the longitudinal direction (X).

The first front retaining member 55 has a first front leading segment 56 and a first front trailing segment 57 which are opposite to each other, and which are coupled to the first front coupling ends 501 of the first front leading and trailing links 51, 52, respectively. The first front retaining member 55 is angularly movable about the first front pivot axis (FP1) between a front non-stretching position and a front stretching position. When first front retaining member 55 is in the first non-stretching position, as shown in FIG. 6, the first front retaining member 55 is remote from the ground. When the first front retaining member 55 is in front stretching position, as shown in FIG. 2, the first front retaining member 55 is close to the ground.

In this embodiment, the first front leading segment 56 and the first front trailing segment 57 of the first front retaining member 55 are disparate from each other.

The first front leading segment 56 has a rearward end 562 and a forward end 561 which is opposite to the rearward end 562 and which is coupled to the first front coupling end 501 of the first front leading link 51.

The first front trailing segment 57 has a forward end 571 and a rearward end 572 which is opposite to the forward end 571 and which is coupled to the first front coupling end 501 of the first front trailing link 52.

The first front linkage unit 5 further includes a pair of first front intermediate links 53 each of which includes a first front coupling end 501 and a first front pivot end 502 that are opposite to each other. The first front coupling end 501 of each of the first front intermediate links 53 is coupled to a corresponding one of the rearward end 562 of the first front leading segment 56 and the forward end 571 of the first front trailing segment 57. The first front pivot end 502 of each of the first front intermediate links 53 is pivotally mounted on the first end segment 301 of a corresponding one of the first and second front intermediate bars 33, 34 about the first front pivot axis (FP1).

The second front retaining member 58 is opposite to the first front retaining member 55 in the transverse direction (Y), and has a second front leading segment 581 and a second front trailing segment 582 which are opposite to each other, and which are coupled to the second end segments 302 of the front leading and trailing bars 31, 32, respectively.

In this embodiment, the second front leading segment 581 and the second front trailing segment 582 of the second front retaining member 58 are disparate from each other.

The second front leading segment 581 has a forward end 583 and a rearward end 584 which are opposite to each other, and which are coupled to the second end segments 302 of the front leading bar 31 and the first front intermediate bar 33, respectively.

The second front trailing segment 582 has a forward end 585 and a rearward end 586 which are opposite to each other and which are coupled to the second end segments 302 of the second front intermediate bar 34 and the front trailing bar 32, respectively.

The first rear linkage unit 6 includes a first rear leading link 61, a first rear trailing link 62, and a first rear retaining member 65.

As best shown in FIG. 6, each of the first rear leading link 61 and the first rear trailing link 62 has a first rear coupling end 601 and a first rear pivot end 602 which is opposite to the first rear coupling end 601, and which is pivotally mounted on the first end segment 401 of a corresponding one of the rear leading and trailing bars 41, 42 about a first rear pivot axis (RP1) in the longitudinal direction (X). In this embodiment, the first rear pivot axis (RP1) is in line with the first front pivot axis (FP1).

The first rear retaining member 65 has a first rear leading segment 66 and a first rear trailing segment 67 which are opposite to each other, and which are coupled to the first rear coupling ends 401 of the first rear leading and trailing links 41, 42, respectively. The first rear retaining member 65 is angularly movable about the first rear pivot axis (RP1) between a rear non-stretching position and a rear stretching position. When the first rear retaining member 65 is in the rear non-stretching position, as shown in FIG. 6, the first rear retaining member 65 is remote from the ground. When the first rear retaining member 65 is in the rear stretching position, as shown in FIG. 2, the first rear retaining member 65 is close to the ground.

In this embodiment, the first rear leading segment 66 and the first rear trailing segment 67 of the first rear retaining member 65 are disparate from each other.

The first rear leading segment 66 has a rearward end 662 and a forward end 661 which is opposite to the rearward end 662 and which is coupled to the first rear coupling end 601 of the first rear leading link 61.

The first rear trailing segment 67 has a forward end 671 and a rearward end 672 which is opposite to the forward end 671 and which is coupled to the first rear coupling end 601 of the first rear trailing link 62.

The first front linkage unit 6 further includes a pair of first rear intermediate links 63 each of which includes a first rear coupling end 601 and a first rear pivot end 602 that are opposite to each other. The first rear coupling end 601 of each of the first rear intermediate links 63 is coupled to a corresponding one of the rearward end 662 of the first rear leading segment 66 and the forward end 671 of the first rear trailing segment 67. The first rear pivot end 602 of each of the first rear intermediate links 63 is pivotally mounted on the first end segment 401 of a corresponding one of the first and second rear intermediate bars 43, 44 about the first rear pivot axis (RP1).

The second rear retaining member 68 is opposite to the first rear retaining member 65 in the transverse direction (Y), and has a second rear leading segment 681 and a second rear trailing segment 682 which are opposite to each other, and which are coupled to the second end segments 402 of the rear leading and trailing bars 41, 42, respectively.

In this embodiment, the second rear leading segment 681 and the second rear trailing segment 682 of the second rear retaining member 68 are disparate from each other.

The second rear leading segment 681 has a forward end 683 and a rearward end 684 which are opposite to each other, and which are coupled to the second end segments 402 of the rear leading bar 41 and the first rear intermediate bar 43, respectively.

The second rear trailing segment 682 has a forward end 685 and a rearward end 686 which are opposite to each other and which are coupled to the second end segments 402 of the second rear intermediate bar 44 and the rear trailing bar 42, respectively.

As shown in FIGS. 1 and 2, the front supporting web 71 is configured to be stretchable on the front support frame unit 3, and has a front web body 711, a first lateral portion 712, and a second lateral portion 715. The first and second lateral portions 712, 715 are connected to a first juncture 701 and a second juncture 702 of the front web body 711, respectively, and are coupled to the first and second front retaining members 55, 58, respectively. When the first front retaining member 55 is displaced to the front stretching position (FIG. 2), the front web body 711 is fully stretched on the front support frame unit 3 (see FIG. 1).

The rear supporting web 72 is configured to be stretchable on the rear support frame unit 4, and has a rear web body 721, a third lateral portion 722, and a fourth lateral portion 725. The third and fourth lateral portions 722, 725 are connected to a third juncture 703 and a fourth juncture 704 of the rear web body 721, respectively, and are coupled to the first and second rear retaining members 65, 68, respectively. When the first rear retaining member 65 is displaced to the rear stretching position (FIG. 2), the rear web body 721 is fully stretched on the rear support frame unit 4 (see FIG. 1).

The front and rear supporting webs 71, 72 can be made from any stretchable materials, such as woven or knitted fabrics, non-woven fabrics, open mesh fabrics, etc. In this embodiment, for supporting a bed mattress, the lightweight modular bed includes the supporting webs 71, 72, rather than board panels, and thus, the lightweight modular bed of this embodiment is easy to disassemble and is more convenient for transportation.

Figure 3:
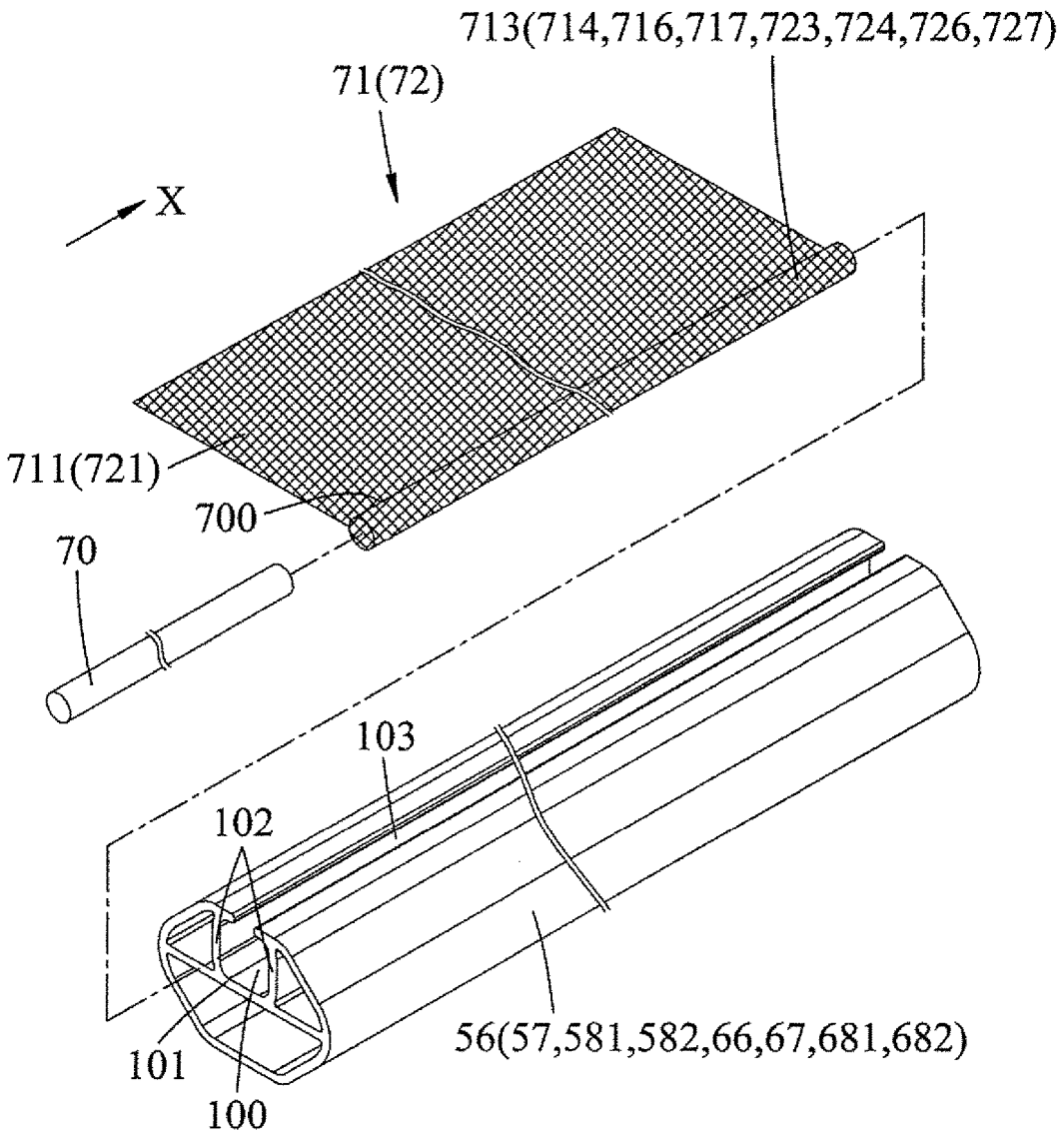
FIG. 3 is an exploded enlarged view illustrating how a lateral portion of a web body in the lightweight modular bed is led into an elongated retaining groove of a retaining member.

In this embodiment, as shown in FIGS. 2 and 3, each of the first front leading and trailing segments 56, 57, the second front leading and trailing segments 581, 582, the first rear leading and trailing segments 66, 67, and the second rear leading and trailing segments 681, 682 has an elongated retaining groove 100 which extends in the longitudinal direction (X), and which has an elongated base 101 and two elongated sidewalls 102 that extend respectively from two opposite edges of the elongated base 101 and toward each other to form an elongated slit 103.

In this embodiment, as shown in FIGS. 2 and 3, the first lateral portion 712 is enlarged compared to the front web body 711, and has a first front segment 713 and a first rear segment 714 which are configured such that once the first front and rear segments 713, 714 have been led into the elongated retaining grooves 100 of the first front leading and trailing segments 56, 57, respectively, the first front and rear segments 713, 714 will be prevented from pulling out of the elongated slits 103 of the first front leading and trailing segments 56, 57, respectively.

The second lateral portion 715 is enlarged compared to the front web body 711, and has a second front segment 716 and a second rear segment 717 which are configured such that once the second front and rear segments 716, 717 have been led into the elongated retaining grooves 100 of the second front leading and trailing segments 581, 582, respectively, the second front and rear segments 716, 717 will be prevented from pulling out of the elongated slits 103 of the second front leading and trailing segments 581, 582, respectively.

The third lateral portion 722 is enlarged compared to the rear web body 721, and has a third front segment 723 and a third rear segment 724 which are configured such that once the third front and rear segments 723, 724 have been led into the elongated retaining grooves 100 of the first rear leading and trailing segments 66, 67, respectively, the third front and rear segments 723, 724 will be prevented from pulling out of the elongated slits 103 of the first rear leading and trailing segments 66, 67, respectively.

The fourth lateral portion 725 is enlarged compared to the rear web body 721, and has a fourth front segment 726 and a fourth rear segment 727 which are configured such that once the fourth front and rear segments 726, 727 have been led into the elongated retaining grooves 100 of the second rear leading and trailing segments 681, 682, respectively, the fourth front and rear segments 726, 727 will be prevented from pulling out of the elongated slits 103 of the second rear leading and trailing segments 681, 682, respectively.

In this embodiment, as shown in FIG. 3, each of the first front and rear segments 713, 714, the second front and rear segments 716, 717, the third front and rear segments 723, 724, and the fourth front and rear segments 726, 727 is in the form of a tubular sleeve 700. The lightweight modular bed further includes eight reinforced rods 70 (only one is shown in FIG. 3). Each of the reinforced rods 70 is configured to be inserted into the corresponding tubular sleeve 700 to ensure the corresponding tubular sleeve 700 be retained in the corresponding elongated retaining groove 100 when a corresponding one of the first front and rear retaining members 55, 65 is displaced to a corresponding one of the front and rear stretching positions (FIG. 2) from a corresponding one of the front and rear non-stretching positions (FIG. 6).

In this embodiment, as shown in FIG. 4, the lightweight modular bed further includes a leg assembly 8 which is configured to elevate and place the front and rear base frames 1, 2 in a stationary state, and which includes a plurality of legs 81.

Referring back to FIGS. 2 and 6, it can be found that in this embodiment, the lightweight modular bed further includes four second front links 59 and four second rear links 69.

Each of the four second front links 59 has a second front pivot end 503 and a second front coupling end 504 which are opposite to each other. The second front pivot end 503 is pivotally mounted on the second end segment 302 of a corresponding one of the front leading and trailing bars 31, 32 and the first and second front intermediate bars 33, 34. The second front coupling end 504 is connected to a corresponding one of the forward and rearward ends 583, 584, 585, 586 of the second front leading segment 581 and the second front trailing segment 582.

Each of the four second rear links 69 has a second rear pivot end 603 and a second rear coupling end 604 which are opposite to each other. The second rear pivot end 603 is pivotally mounted on the second end segment 402 of a corresponding one of the rear leading and trailing bars 41, 42 and the first and second rear intermediate bars 43, 44. The second rear coupling end 604 is connected to a corresponding one of the forward and rearward ends 683, 684, 685, 686 of the second rear leading segment 681 and the second rear trailing segment 682.

Figure 5:
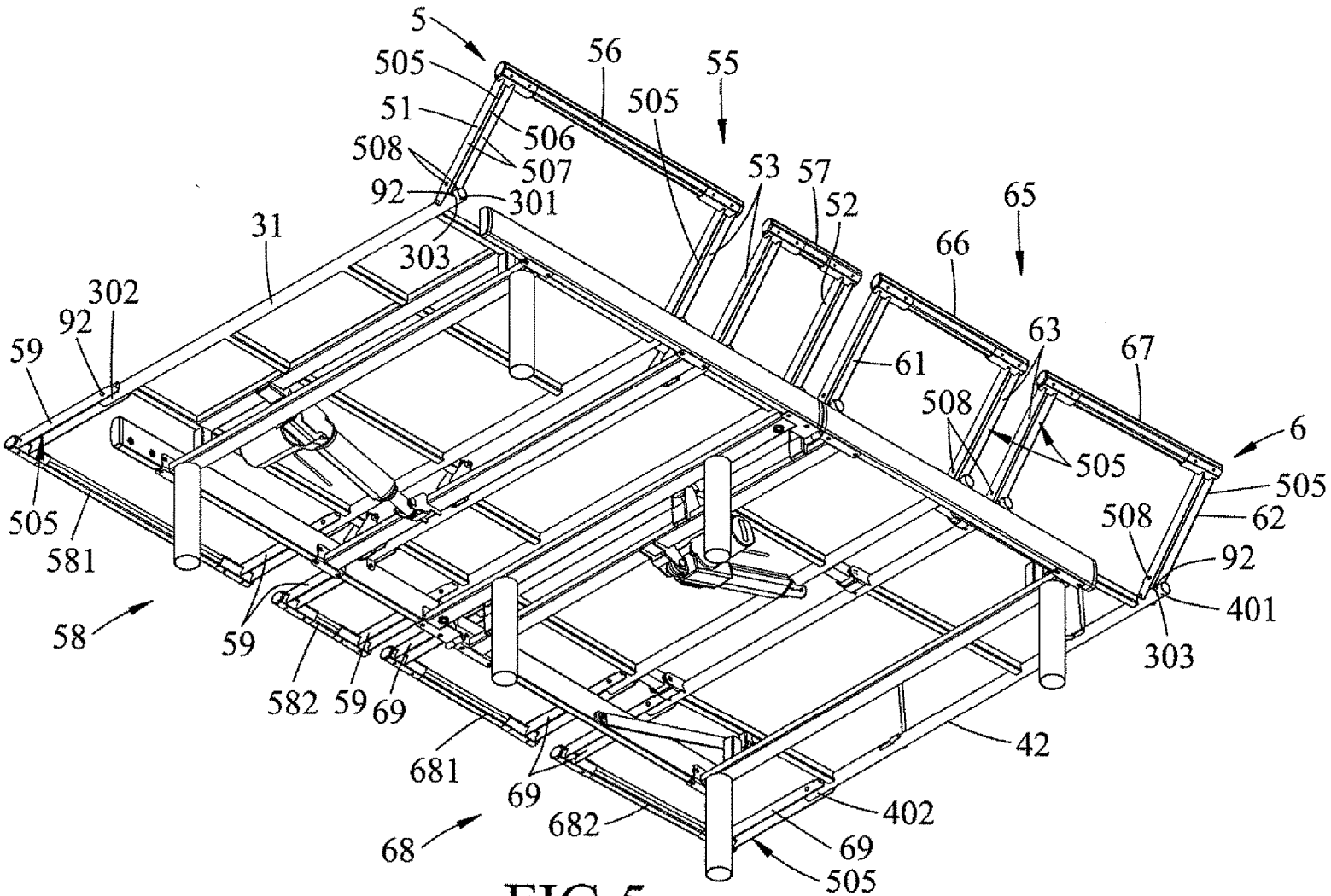
FIG. 5 is similar to FIG. 4 but illustrating viewing from an opposite side.
Figure 7:
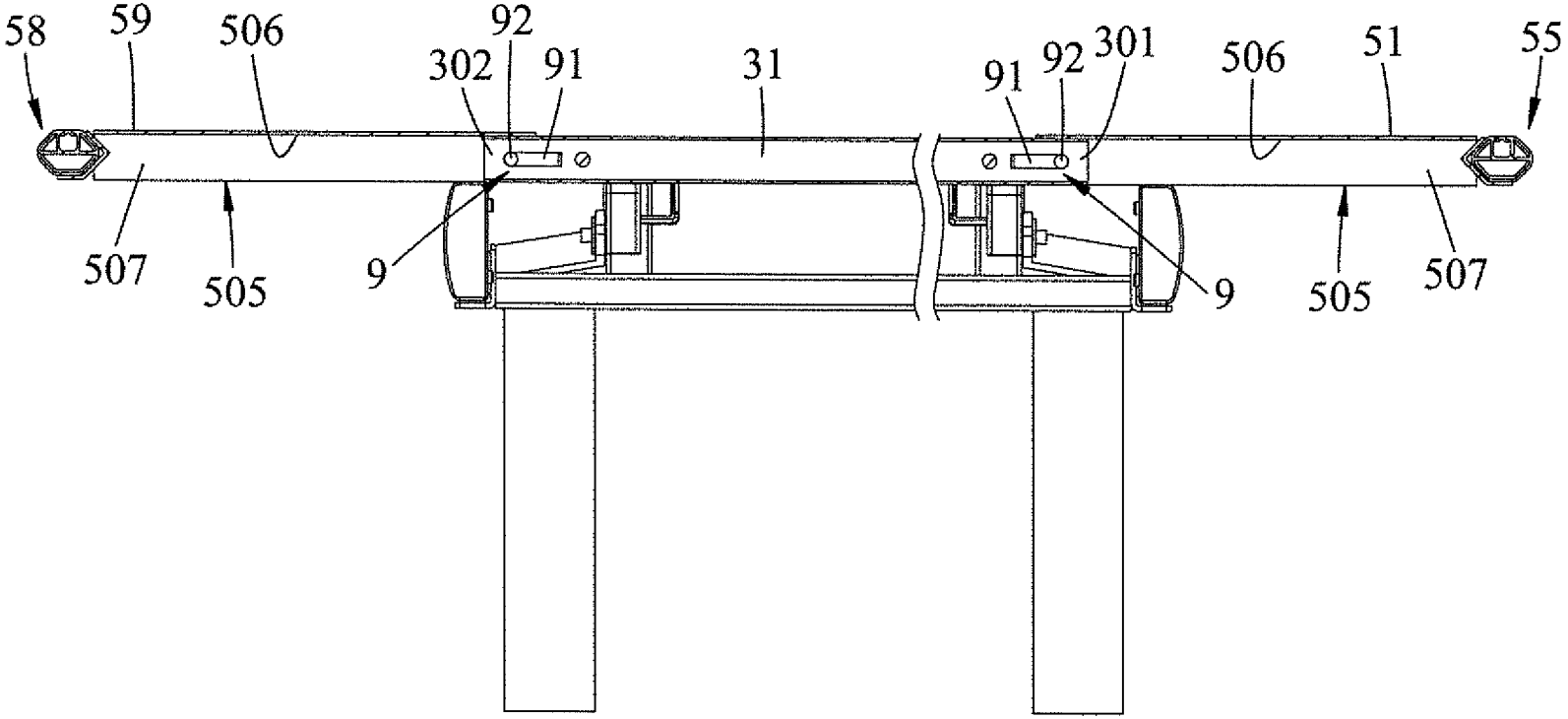
FIG. 7 is a front side view of the lightweight modular bed.
Figure 8:
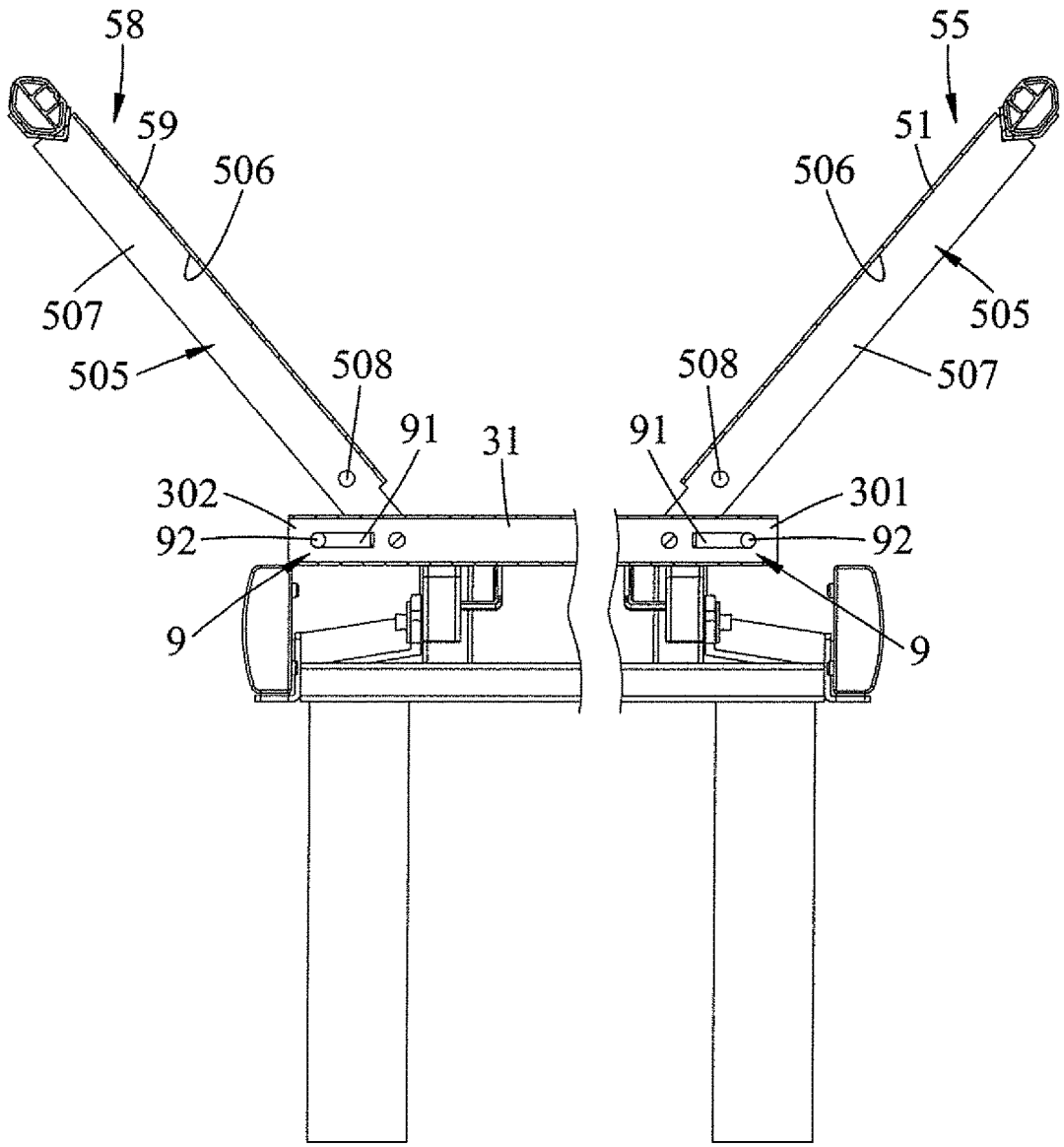
FIG. 8 is similar to FIG. 7 but illustrating the first front retaining member in the front non-stretching position.

In this embodiment, as shown in FIG. 5, each of the front leading link 51, the first front trailing link 52, the first front intermediate links 53, the first rear leading link 61, the first rear trailing link 62, the first rear intermediate links 63, the second front links 59, and the second rear links 69 is formed with an elongated groove 505 which is configured to receive a corresponding one of the first and second end segments 301, 302, 401, 402 of the front leading and trailing bars 31, 32, the first and second front intermediate bars 33, 34, the rear leading and trailing bars 41, 42, and the first and second rear intermediate bars 43, 44, when a corresponding one of the front and rear web bodies 711, 721 is fully stretched. As shown in FIGS. 5, 7, and 8, the elongated groove 505 has a groove base 506 and two opposing walls 507 each extending downwardly from the groove base 506, and each having a catch area 508. Each of the first and second end segments 301, 302, 401, 402 is hollow inside, and is formed with two opposite holes 303 which are in line with the catch areas 508 of the two opposing walls 507 of a corresponding elongated groove 505 when a corresponding one of the front and rear web bodies 711, 721 is fully stretched.

In this embodiment, the lightweight modular bed further includes a plurality of leaf springs 9 (only two are shown in FIGS. 7 and 8) for positioning each of the front leading link 51, the first front trailing link 52, the first front intermediate links 53, the first rear leading link 61, the first rear trailing link 62, the first rear intermediate links 63, the second front links 59, and the second rear links 69 to a corresponding one of the first and second end segments 301, 302, 401, 402 when a corresponding one of the front and rear web bodies 711, 721 is fully stretched.

Each of the leaf springs 9 includes a bent portion 91 and two spring ends 92 (only one is shown in FIGS. 7 and 8). The bent portion 91 is disposed inside a corresponding one of the first and second end segments 301, 302, 401, 402. The two spring ends 92 are disposed to extend outwardly of the opposite holes 303 (see FIG. 5) of the corresponding one of the first and second end segments 301, 302, 401, 402, and are configured to be caught by the catch areas 508 of the opposing walls 507 of a corresponding elongated groove 505 when a corresponding one of the front and rear web bodies 711, 721 is fully stretched.

It should be noted that the lightweight modular bed may be designed for a double bed and may be converted into a single bed by removing the first front and rear linkage units 5, 6, the second front and rear retaining members 58, 68, the second front and rear links 59, 69, and the front and rear supporting webs 71, 72, followed by mounting four supporting boards (not shown) on the front and rear support frame units 3, 4.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A lightweight modular bed comprising:

a front base frame;

a rear base frame which is aligned with said front base frame in a longitudinal direction to permit said front and rear base frames to be arranged in a head-to-tail arrangement;

a front support frame unit mounted on said front base frame, and including a front leading bar extending in a transverse direction relative to the longitudinal direction to terminate at a first end segment and a second end segment, and a front trailing bar which is spaced apart from said front leading bar in the longitudinal direction, and which extends in the transverse direction to terminate at a first end segment and a second end segment;

a rear support frame unit mounted on said rear base frame, and including a rear leading bar extending in the transverse direction to terminate at a first end segment and a second end segment, and a rear trailing bar which is spaced apart from said rear leading bar in the longitudinal direction, and which extends in the transverse direction to terminate at a first end segment and a second end segment;

a first front linkage unit including a first front leading link and a first front trailing link each of which has a first front coupling end and a first front pivot end that is opposite to said first front coupling end, and that is pivotally mounted on said first end segment of a corresponding one of said front leading and trailing bars about a first front pivot axis in the longitudinal direction, and a first front retaining member having a first front leading segment and a first front trailing segment which are opposite to each other, and which are coupled to said first front coupling ends of said first front leading and trailing links, respectively, said first front retaining member being angularly movable about the first front pivot axis between a front non-stretching position, where said first front retaining member is remote from the ground, and a front stretching position, where said first front retaining member is close to the ground;

a second front retaining member which is opposite to said first front retaining member in the transverse direction, and which has a second front leading segment and a second front trailing segment that are opposite to each other, and that are coupled to said second end segments of said front leading and trailing bars, respectively;

a first rear linkage unit including a first rear leading link and a first rear trailing link each of which has a first rear coupling end and a first rear pivot end that is opposite to said first rear coupling end, and that is pivotally mounted on said first end segment of a corresponding one of said rear leading and trailing bars about a first rear pivot axis in the longitudinal direction, and a first rear retaining member having a first rear leading segment and a first rear trailing segment which are opposite to each other, and which are coupled to said first rear coupling ends of said first rear leading and trailing links, respectively, said first rear retaining member being angularly movable about the first rear pivot axis between a rear non-stretching position, where said first rear retaining member is remote from the ground, and a rear stretching position, where said first rear retaining member is close to the ground;

a second rear retaining member which is opposite to said first rear retaining member in the transverse direction, and which has a second rear leading segment and a second rear trailing segment that are opposite to each other, and that are coupled to said second end segments of said rear leading and trailing bars, respectively;

a front supporting web configured to be stretchable on said front support frame unit, and having a front web body, and a first lateral portion and a second lateral portion, which are connected to a first juncture and a second juncture of said front web body, respectively, and which are coupled to said first and second front retaining members, respectively, such that when said first front retaining member is displaced to said front stretching position, said front web body is fully stretched on said front support frame unit; and a rear supporting web configured to be stretchable on said rear support frame unit, and having a rear web body, and a third lateral portion and a fourth lateral portion, which are connected to a third juncture and a fourth juncture of said rear web body, respectively, and which are coupled to said first and second rear retaining members, respectively, such that when said first rear retaining member is displaced to said rear stretching position, said rear web body is fully stretched on said rear support frame unit, wherein:

each of said first front leading and trailing segments, said second front leading and trailing segments, said first rear leading and trailing segments, and said second rear leading and trailing segments has an elongated retaining groove which has an elongated base and two elongated sidewalls that extend respectively from two opposite edges of said elongated base and toward each other to form an elongated slit;

said first lateral portion is enlarged compared to said front web body, and has a first front segment and a first rear segment which are configured such that once said first front and rear segments have been led into said elongated retaining grooves of said first front leading and trailing segments, respectively, said first front and rear segments will be prevented from pulling out of said elongated slits of said first front leading and trailing segments, respectively;

said second lateral portion is enlarged compared to said front web body, and has a second front segment and a second rear segment which are configured such that once said second front and rear segments have been led into said elongated retaining grooves of said second front leading and trailing segments, respectively, said second front and rear segments will be prevented from pulling out of said elongated slits of said second front leading and trailing segments, respectively;

said third lateral portion is enlarged compared to said rear web body, and has a third front segment and a third rear segment which are configured such that once said third front and rear segments have been led into said elongated retaining grooves of said first rear leading and trailing segments, respectively, said third front and rear segments will be prevented from pulling out of said elongated slits of said first rear leading and trailing segments, respectively; and said fourth lateral portion is enlarged compared to said rear web body, and has a fourth front segment and a fourth rear segment which are configured such that once said fourth front and rear segments have been led into said elongated retaining grooves of said second rear leading and trailing segments, respectively, said fourth front and rear segments will be prevented from pulling out of said elongated slits of said second rear leading and trailing segments, respectively.

2. The lightweight modular bed according to claim 1, wherein each of said first front and rear segments, said second front and rear segments, said third front and rear segments, and said fourth front and rear segments is in the form of a tubular sleeve, said lightweight modular bed further comprising eight reinforced rods each of which is configured to be inserted into said corresponding tubular sleeve to ensure said corresponding tubular sleeve be retained in said corresponding elongated retaining groove when a corresponding one of said first front and rear retaining members is displaced to a corresponding one of said front and rear stretching positions from a corresponding one of said front and rear non-stretching positions.

3. The lightweight modular bed according to claim 1, further comprising a leg assembly configured to elevate and place said front and rear base frames in a stationary state, and including a plurality of legs.

4. The lightweight modular bed according to claim 1, wherein:

said front base frame includes two front beams each of which extends in the longitudinal directions to terminate at a front end segment and a first connecting end segment, and each of which has an intermediate segment between said front end segment and said first connecting end segment, said front beams being spaced apart from each other in the transverse direction, a first front transverse beam extending to interconnect said front end segments of said front beams, and a second front transverse beam extending to interconnect said intermediate segments of said front beams; and said rear base frame includes two rear beams which are spaced apart from each other in the transverse direction, each of said rear beams extending in the longitudinal direction to terminate at a rear end segment and a second connecting end segment that is hingedly connected to said first connecting end segment of a corresponding one of said front beams, a first rear transverse beam extending to interconnect said second connecting end segments of said rear beams, and a second rear transverse beams extending to interconnect said rear end segments of said rear beams.

5. The lightweight modular bed according to claim 4, wherein:

said front support frame unit further includes a pair of head support links each having a front link pivot end mounted pivotally on said second front transverse beam about a front axis in proximity to a corresponding one of said intermediate segments of said front beams, a front link coupling end which is opposite to said front link pivot end, and which is connected to said front leading bar in proximity to a corresponding one of said first and second end segments of said front leading bar to permit said head support links to move with said front leading bar such that said front leading bar is rotatably liftable about said front axis from a head normal position, where said front leading bar is close to the ground, to a head elevated position, where said front leading bar is remote from the ground, a first front intermediate bar extending in the transverse direction to interconnect said head support links in proximity to said front link pivot ends of said head support links so as to move with said head support links, said first front intermediate bar having a first end segment and a second end segment which are opposite to each other, and which are disposed outboard of said head support links, and a second front intermediate bar which extends in the transverse direction to terminate at a first end segment and a second end segment, and which is disposed between said first front intermediate bar and said front trailing bar, said second front intermediate bar, together with said front trailing bar, being secured on said front beams;

said rear support frame unit further includes a pair of front leg support links each having a first rearward pivot end and a first forward pivot end which is opposite to said first rearward pivot end and which is mounted pivotally on said first rear transverse beam about a rear axis in proximity to a corresponding one of said second connecting end segments of said rear beams, said front leg support links being interconnected by said rear leading bar in proximity to said first forward pivot ends of said first leg support links so as to permit said rear leading bar to move with said front leg support links, said first and second end segments of said rear leading bar being disposed outboard of said front leg support links, a pair of rear leg support links each having a second forward pivot end which is hingedly mounted to said first rearward pivot end of a corresponding one of said front leg support links, a second rearward connected end which is opposite to said second forward pivot end, and which is mounted on said rear trailing bar in proximity to a corresponding one of said first and second end segments of said rear trailing bar, a first rear intermediate bar extending in the transverse direction through said front leg support links in proximity to said first rearward pivot ends of said front leg support links to terminate at a first end segment and a second end segment so as to permit said first rear intermediate bar to be rotatably liftable about said rear axis from a leg normal position, where said first rear intermediate bar is close to the ground, to a leg elevated position, where said first rear intermediate bar is remote from the ground, and a second rear intermediate bar extending in the transverse direction through said rear leg support links in proximity to said second forward pivot ends of said rear leg support links to terminate at a first end segment and a second end segment so as to permit said second rear intermediate bar to be lifted when said first rear intermediate bar is lifted to said leg elevated position from said leg normal position;

said first front leading segment and said first front trailing segment of said first front retaining member are disparate from each other;

said first front leading segment has a rearward end and a forward end which is opposite to said rearward end and which is coupled to said first front coupling end of said first front leading link;

said first front trailing segment has a forward end and a rearward end which is opposite to said forward end and which is coupled to said first front coupling end of said first front trailing link;

said first front linkage unit further includes a pair of first front intermediate links each of which includes a first front coupling end which is coupled to a corresponding one of said rearward end of said first front leading segment and said forward end of said first front trailing segment, and a first front pivot end which is opposite to said first front coupling end, and which is pivotally mounted on said first end segment of a corresponding one of said first and second front intermediate bars about said first front pivot axis;

said second front leading segment and said second front trailing segment of said second front retaining member are disparate from each other;

said second front leading segment has a forward end and a rearward end which are opposite to each other, and which are coupled to said second end segments of said front leading bar and said first front intermediate bar, respectively;

said second front trailing segment has a forward end and a rearward end which are opposite to each other and which are coupled to said second end segments of said second front intermediate bar and said front trailing bar, respectively;

said first rear leading segment and said first rear trailing segment of said first rear retaining member are disparate from each other;

said first rear leading segment has a rearward end and a forward end which is opposite to said rearward end and which is coupled to said first rear coupling end of said first rear leading link;

said first rear trailing segment has a forward end and a rearward end which is opposite to said forward end and which is coupled to said first rear coupling end of said first rear trailing link;

said first front linkage unit further includes a pair of first rear intermediate links each of which includes a first rear coupling end which is coupled to a corresponding one of said rearward end of said first rear leading segment and said forward end of said first rear trailing segment, and a first rear pivot end which is opposite to said first rear coupling end, and which is pivotally mounted on said first end segment of a corresponding one of said first and second rear intermediate bars about said first rear pivot axis;

said second rear leading segment and said second rear trailing segment of said second rear retaining member are disparate from each other;

said second rear leading segment has a forward end and a rearward end which are opposite to each other, and which are coupled to said second end segments of said rear leading bar and said first rear intermediate bar, respectively; and said second rear trailing segment has a forward end and a rearward end which are opposite to each other and which are coupled to said second end segments of said second rear intermediate bar and said rear trailing bar, respectively.

6. The lightweight modular bed according to claim 5, further comprising:

four second front links each of which has a second front pivot end which is pivotally mounted on said second end segment of a corresponding one of said front leading and trailing bars and said first and second front intermediate bars, and a second front coupling end which is opposite to said second front pivot end, and which is connected to a corresponding one of said forward and rearward ends of said second front leading segment and said second front trailing segment; and four second rear links each of which has a second rear pivot end which is pivotally mounted on said second end segment of a corresponding one of said rear leading and trailing bars and said first and second rear intermediate bars, and a second rear coupling end which is opposite to said second rear pivot end, and which is connected to a corresponding one of said forward and rearward ends of said second rear leading segment and said second rear trailing segment.

7. The lightweight modular bed according to claim 1, wherein said first front leading link is formed with an elongated groove which is configured to receive said first end segment of said front leading bar when said front web body is fully stretched, and which has a groove base and two opposing walls each extending downwardly from said groove base, and each having a catch area, said first end segment of said front leading bar being hollow inside, and being formed with two opposite holes which are in line with said catch areas of said two opposing walls when said front web body is fully stretched, said lightweight modular bed further comprising a leaf spring which includes a bent portion which is disposed inside said first end segment of said front leading bar, and two spring ends which are disposed to extend outwardly of said opposite holes of said first end segment of said front leading bar, respectively, and which are configured to be caught by said catch areas of said opposing walls when said front web body is fully stretched.

* * * * *